US012781762B2

(12) United States Patent
Notoji et al.

(10) Patent No.: US 12,781,762 B2
(45) Date of Patent: Nov. 3, 2026

(54) MAGNETIC LEVITATION TYPE PUMP

(71) Applicant: PILLAR Corporation, Osaka (JP)

(72) Inventors: Yu Notoji, Osaka (JP); Kohei Yamauchi, Osaka (JP)

(73) Assignee: PILLAR CORPORATION, Osaka (JP)

( * ) Notice: Subject to any disclaimer, the term of this patent is extended or adjusted under 35 U.S.C. 154(b) by 0 days.

(21) Appl. No.: 19/179,330

(22) Filed: Apr. 15, 2025

(65) Prior Publication Data

US 2026/0160260 A1 Jun. 11, 2026

(30) Foreign Application Priority Data

Apr. 16, 2024 (JP) ..... 2024-065907

(51) Int. Cl.
*F04D 29/42* (2006.01)
*F04D 1/00* (2006.01)
(Continued)

(52) U.S. Cl.
CPC ..... *F04D 29/4273* (2013.01); *F04D 1/00* (2013.01); *F04D 13/024* (2013.01);
(Continued)

(58) Field of Classification Search
CPC .. F04D 29/058; F04D 13/0646; F04D 29/047; F04D 13/064; F04D 13/027;
(Continued)

(56) References Cited

U.S. PATENT DOCUMENTS 6,171,078 B1 * 1/2001 Schob ..... A61M 60/824 417/423.1
6,418,927 B1 * 7/2002 Kullik ..... A62B 9/00 417/424.2

(Continued)

FOREIGN PATENT DOCUMENTS

JP 2021046860 A 3/2021

OTHER PUBLICATIONS

M. Ertan Taskin et al., "Computational Characterization of Flow and Hemolytic Performance of the UltraMag Blood Pump for Circulatory Support" Artificial Organs, 2010, 34(12):1099-1113 (15 pages).

(Continued)

*Primary Examiner* — Peter J Bertheaud
(74) *Attorney, Agent, or Firm* — Osha Bergman Watanabe & Burton LLP

(57) ABSTRACT

A volute portion of a casing in a magnetic levitation type pump has a top wall, a bottom wall, and a circumferential wall. The top wall has a radially inner wall portion that is placed with a gap on one side in an axial direction with respect to an impeller, and a radially outer wall portion that is placed on an outer side in a radial direction with respect to the impeller. A volute flow path in which a transport fluid that has flowed out from the impeller flows is formed between the impeller and the circumferential wall and between the radially outer wall portion and the bottom wall in the volute portion so as to communicate with the gap. At least a part of the radially outer wall portion extends from a radially outer end of the radially inner wall portion toward the one side in the axial direction.

2 Claims, 8 Drawing Sheets

(51) Int. Cl.

| | |
|---|---|
| ***F04D 13/02*** | (2006.01) |
| ***F04D 13/06*** | (2006.01) |
| ***F04D 29/047*** | (2006.01) |
| ***F04D 29/048*** | (2006.01) |
| ***F04D 29/62*** | (2006.01) |

(52) U.S. Cl.
CPC ..... *F04D 13/026* (2013.01); *F04D 13/027* (2013.01); *F04D 13/06* (2013.01); *F04D 13/0606* (2013.01); *F04D 13/064* (2013.01); *F04D 13/0646* (2013.01); *F04D 13/0666* (2013.01); *F04D 29/047* (2013.01); *F04D 29/048* (2013.01); *F04D 29/426* (2013.01); *F04D 29/628* (2013.01)

(58) Field of Classification Search
CPC .. F04D 13/026; F04D 29/628; F04D 13/0606; F04D 13/024; F04D 1/00; F04D 29/426; F04D 13/06; F04D 13/0666; F04D 29/048
See application file for complete search history.

(56) References Cited

U.S. PATENT DOCUMENTS

| | | | | |
|---|---|---|---|---|
| 6,637,433 | B2 * | 10/2003 | Schob | F04D 25/0606 128/204.19 |
| 10,995,759 | B2 * | 5/2021 | Pae | F04D 13/0606 |
| 11,421,694 | B2 | 8/2022 | Simmons et al. | |
| 2021/0079922 | A1 * | 3/2021 | Schmid | F04D 17/161 |

OTHER PUBLICATIONS

Elsbeth Heinzelmann, "A Novel Approach to Shear-sensitive Fluids When Research and Industry Get Creative Together" Biotechnet Switzerland, Chimia vol. 68, No. 12, 2014, pp. 896-898 (3 pages).
Peng Wu et al., "The Design and Evaluation of a Portable Extracorporeal Centrifugal Blood Pump" Frontiers in Physiology, Oct. 14, 2021, vol. 12 (7 pages).

* cited by examiner

MAGNETIC LEVITATION TYPE PUMP

TECHNICAL FIELD

The present disclosure relates to a magnetic levitation type pump. This application claims priority on Japanese Patent Application No. 2024-065907 filed on Apr. 16, 2024, the entire content of which is incorporated herein by reference.

BACKGROUND ART

A centrifugal pump described in PATENT LITERATURE 1 is known as a magnetic levitation type pump in which a rotary shaft is levitated by magnetism and supported in a non-contact manner relative to a casing. The magnetic levitation type pump described in PATENT LITERATURE 1 includes a casing, a rotary shaft, a motor, and a magnetic bearing. The rotary shaft is rotatably supported in a non-contact manner in a radial direction relative to the casing by magnetism generated from the magnetic bearing and is rotationally driven by the motor.

The magnetic levitation type pump further includes an impeller that rotates together with the rotary shaft in the casing. The impeller has a main plate and a plurality of vanes that are provided on the main plate. When the impeller rotates together with the rotary shaft, a transport fluid is sucked into the casing through a suction port that is formed on one side in an axial direction of the casing. The transport fluid sucked into the casing is discharged to the outside of the casing through a discharge port that is formed at the outer circumference of the casing, by the plurality of vanes of the impeller.

CITATION LIST

Patent Literature

PATENT LITERATURE 1: Japanese Laid-Open Patent Publication No. 2021-046860

SUMMARY OF THE INVENTION

Technical Problem

In the above magnetic levitation type pump, due to the structure of the centrifugal pump, the pressure of the transport fluid decreases in the vicinity of the suction port of the casing, so that a pressure difference of the transport fluid occurs in the axial direction in the casing. If this pressure difference becomes larger, a thrust force pushing the impeller toward the one side in the axial direction (suction port side) increases, so that the impeller, which is supported by magnetism alone, may move toward the one side in the axial direction due to the thrust force, come into contact with the casing, and be damaged.

The present disclosure has been made in view of such circumstances, and an object of the present disclosure is to provide a magnetic levitation type pump that can suppress movement of an impeller in an axial direction.

Solution to Problem (1) A magnetic levitation type pump of the present disclosure includes: a rotary shaft rotatable around an axis; a motor configured to rotationally drive the rotary shaft; a magnetic bearing portion supporting the rotary shaft in a non-contact manner; a casing having a volute portion in which a suction port for a transport fluid is formed on one side in an axial direction; and an impeller placed inside the volute portion so as to be rotatable together with the rotary shaft and having an outlet for the transport fluid at an outer circumference thereof. The volute portion has an annular top wall that is placed on the one side in the axial direction with respect to the impeller, a bottom wall that is placed on another side in the axial direction with respect to the impeller, and a cylindrical circumferential wall that is placed on an outer side in a radial direction with respect to the impeller and has end portions in the axial direction connected to the top wall and the bottom wall, respectively. The top wall has a radially inner wall portion that is placed with a gap on the one side in the axial direction with respect to the impeller, and a radially outer wall portion that is placed on the outer side in the radial direction with respect to the impeller. A volute flow path in which the transport fluid that has flowed out from the outlet flows is formed between the impeller and the circumferential wall and between the radially outer wall portion and the bottom wall in the volute portion so as to communicate with the gap. At least a part of the radially outer wall portion extends from a radially outer end of the radially inner wall portion toward the one side in the axial direction.

In the magnetic levitation type pump of the present disclosure, the volute flow path on the outer side in the radial direction with respect to the impeller in the volute portion is formed such that the flow path cross-sectional area thereof is expanded from the radially outer end of the gap between the radially inner wall portion of the top wall and the impeller toward the one side in the axial direction (suction port side) by the radially outer wall portion of the top wall. This expansion region is formed so as to extend away from the impeller toward the one side in the axial direction, so that the speed of the transport fluid flowing through the expansion region decreases and the pressure of the transport fluid in the expansion region increases. As a result, the increased pressure in the expansion region propagates to the gap and the pressure of the transport fluid in the gap increases, so that the thrust force pushing the impeller toward the other side in the axial direction increases. Accordingly, the movement of the impeller toward the one side in the axial direction due to the pressure of the transport fluid being decreased in the vicinity of the suction port of the volute portion as in the conventional art can be suppressed.

(2) In the magnetic levitation type pump in (1) above, preferably, at least the part of the radially outer wall portion extends diagonally from the radially outer end of the radially inner wall portion toward the one side in the axial direction and the outer side in the radial direction.

In this case, the transport fluid in the expansion region of the volute flow path flows smoothly along the radially outer wall portion, which extends diagonally, so that the transport fluid can be inhibited from staying in the expansion region. As a result, a decrease in the performance of transporting the transport fluid by the magnetic levitation type pump can be suppressed.

(3) In the magnetic levitation type pump in (2) above, preferably, the radially outer wall portion extends diagonally toward the one side in the axial direction and the outer side in the radial direction, from the radially outer end of the radially inner wall portion to the circumferential wall.

In this case, the transport fluid in the expansion region of the volute flow path flows further smoothly along the radially outer wall portion, which extends diagonally, so that a decrease in the performance of transporting the transport fluid by the magnetic levitation type pump can be further suppressed.

Advantageous Effects of the Invention

In the magnetic levitation type pump of the present disclosure, it is possible to suppress movement of the impeller in the axial direction.

DETAILED DESCRIPTION

Next, preferred embodiments will be described with reference to the accompanying drawings.

First Embodiment

[Entire Configuration]

Figure 1:
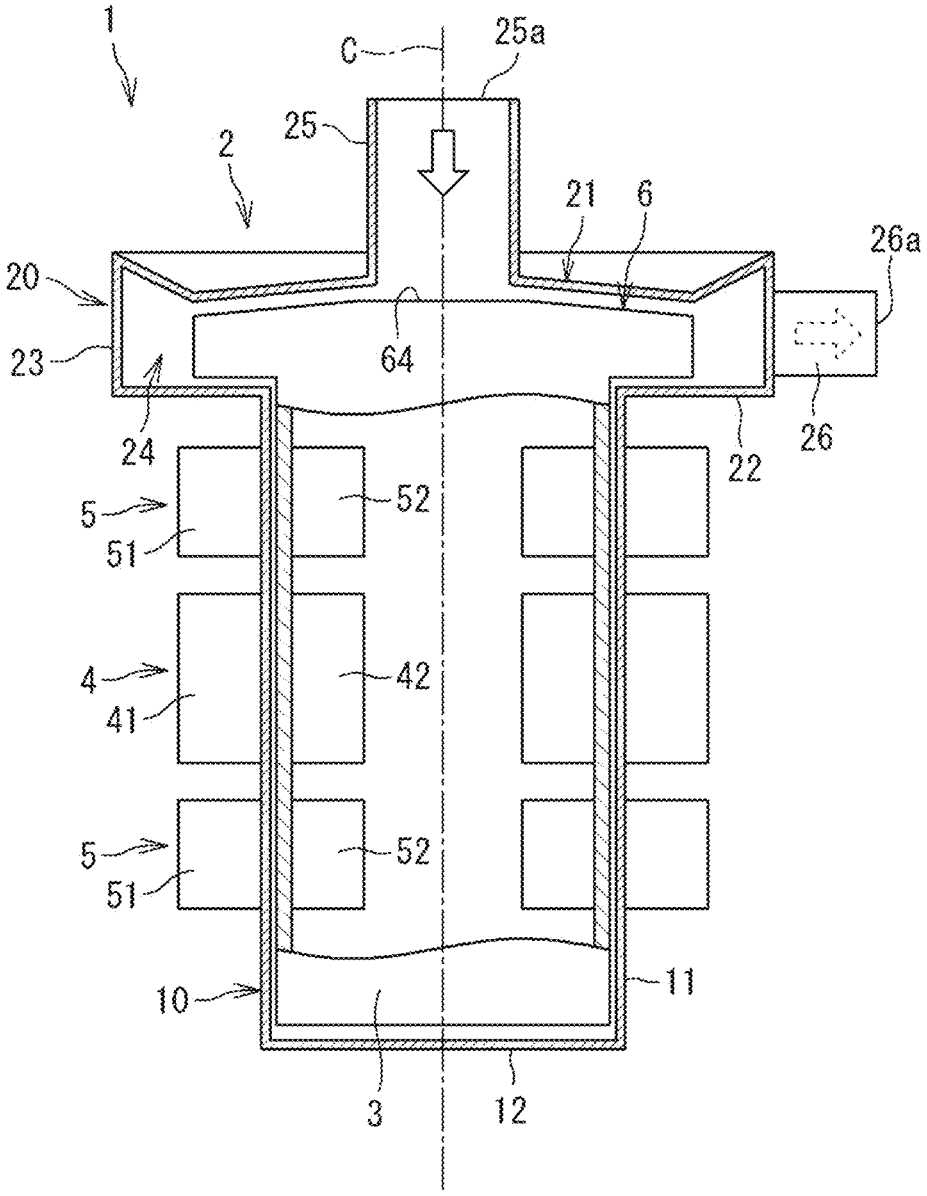
FIG. 1 is a schematic cross-sectional view showing a magnetic levitation type pump according to a first embodiment of the present disclosure.

FIG. 1 is a schematic cross-sectional view showing a magnetic levitation type pump 1 according to a first embodiment of the present disclosure. In FIG. 1, the magnetic levitation type pump 1 of the present embodiment (hereinafter also simply referred to as "pump 1") is composed of a centrifugal pump. The pump 1 includes a casing 2, a rotary shaft 3, a motor 4, a pair of magnetic bearing portions 5, and an impeller 6. The pump 1 is placed such that an axis C thereof is directed in the up-down direction, but may be placed such that the axis C thereof is directed in a horizontal direction.

In the present disclosure, a direction along the axis C of the pump 1 is the axial direction of the pump 1 and is simply referred to as "axial direction" below. In addition, the upper side in FIG. 1 (one side in the axial direction) is referred to as "upper side in the axial direction", and the lower side in FIG. 1 (other side in the axial direction) is referred to as "lower side in the axial direction". A direction orthogonal to the axis C is the radial direction of the pump 1 and is simply referred to as "radial direction" below. The direction of rotation around the axis C is the circumferential direction of the pump 1 and is simply referred to as "circumferential direction" below.

The casing 2 includes a housing portion 10 in which the rotary shaft 3 is housed, and a volute portion 20 that is provided on the upper side in the axial direction of the housing portion 10. The housing portion 10 has a cylindrical wall 11 and a disc wall 12 that is provided on the lower side in the axial direction of the cylindrical wall 11. The cylindrical wall 11 is formed in a cylindrical shape centered at the axis C. The disc wall 12 is formed in a disc shape and closes the opening on the lower side in the axial direction of the cylindrical wall 11.

The rotary shaft 3 is placed in the housing portion 10 so as to be rotatable around the axis C. The rotary shaft 3 is formed, for example, in a cylindrical shape. An upper axial end portion of the rotary shaft 3 enters the inside of the volute portion 20.

The motor 4 rotationally drives the rotary shaft 3. The motor 4 has a stator 41 that is provided on the housing portion 10, and a rotor 42 that is provided on the rotary shaft 3. The stator 41 is fixed to a center portion in the axial direction of the outer circumferential surface of the cylindrical wall 11. The rotor 42 is fixed to the inner circumferential surface of the rotary shaft 3 at a position facing the stator 41 in the radial direction. When a current is applied to the stator 41, a rotating magnetic field is generated, whereby the rotor 42 rotates around the axis C together with the rotary shaft 3.

The pair of magnetic bearing portions 5 support the rotary shaft 3 in a non-contact manner. Each magnetic bearing portion 5 has a magnetism generation portion 51 that is provided on the housing portion 10, and a magnetic body 52 that is provided on the rotary shaft 3. The magnetism generation portions 51 are placed on both sides in the axial direction of the stator 41 and fixed to the outer circumferential surface of the cylindrical wall 11. Each magnetic body 52 is fixed to the inner circumferential surface of the rotary shaft 3 at a position facing the magnetism generation portion 51 in the radial direction. The rotary shaft 3 is supported in a non-contact manner by magnetism generated by each magnetism generation portion 51 and each magnetic body 52.

The impeller 6 is placed in the volute portion 20. The impeller 6 is provided on the upper side in the axial direction of the rotary shaft 3 and is rotatable around the axis C together with the rotary shaft 3. The impeller 6 is a closed impeller.

Figure 2:
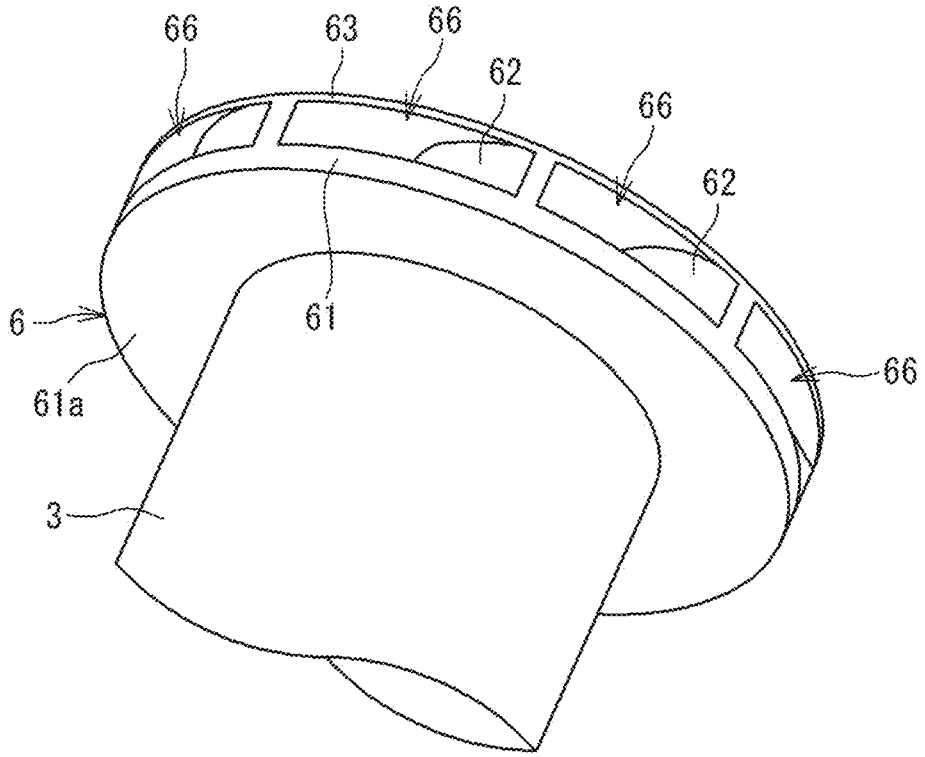
FIG. 2 is a perspective view of an impeller as seen from the lower side in an axial direction.
Figure 3:
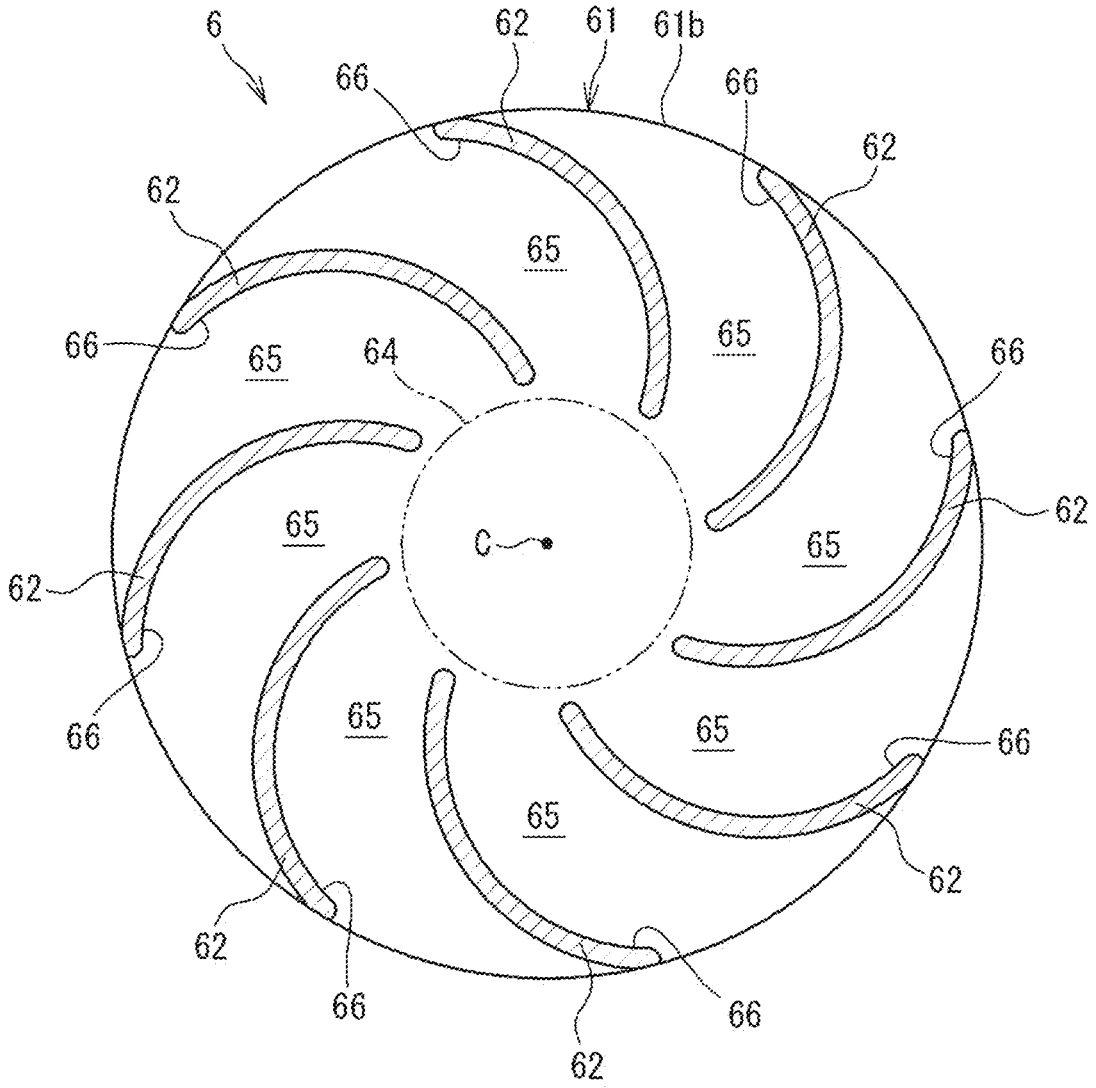
FIG. 3 is a cross-sectional view showing the inside of the impeller.

FIG. 2 is a perspective view of the impeller 6 as seen from the lower side in the axial direction. FIG. 3 is a cross-sectional view showing the inside of the impeller 6. In FIG. 2 and FIG. 3, the impeller 6 includes a main plate 61, a plurality of vanes 62, and a side plate (shroud) 63. The main plate 61 is formed in a disc shape centered at the axis C. The outer diameter of the main plate 61 is larger than the outer diameter of the rotary shaft 3. The upper axial end of the rotary shaft 3 is fixed to an outer surface 61*a* on the lower side in the axial direction of the main plate 61.

The plurality of vanes 62 are provided at equal intervals in the circumferential direction on an inner surface 61*b* on the upper side in the axial direction of the main plate 61. Each vane 62 is formed, for example, in an arc plate shape. The impeller 6 of the present embodiment includes eight vanes 62. The plate thickness, shape, and number of vanes 62 are not limited to those of the present embodiment.

The side plate 63 is provided on the upper side in the axial direction of the plurality of vanes 62. The side plate 63 is formed in an annular shape centered at the axis C. The side plate 63 of the present embodiment extends diagonally toward the lower side in the axial direction and the outer side in the radial direction, from the radially inner end to the radially outer end thereof. The outer diameter of the side plate 63 is the same as the outer diameter of the main plate 61. The inner peripheral hole of the side plate 63 is an inlet 64 through which a transport fluid flows into the impeller 6. The inlet 64 is formed on the inner side in the radial direction with respect to the plurality of vanes 62.

Between the main plate 61 and the side plate 63, a flow path 65 in which the transport fluid that has flowed into the impeller 6 through the inlet 64 flows from the inner side in the radial direction toward the outer side in the radial direction is formed between the vanes 62 adjacent to each other in the circumferential direction. The opening on the outer side in the radial direction of each flow path 65 is an outlet 66 through which the transport fluid flows out of the impeller 6. Therefore, a plurality of outlets 66 through which the transport fluid flows out of the impeller 6 are formed at the outer circumference of the impeller 6.

[Volute Portion]

In FIG. 1, the volute portion 20 has a top wall 21 and a bottom wall 22 each of which is formed in an annular shape centered at the axis C, and a circumferential wall 23 that is formed in a cylindrical shape centered at the axis C. The circumferential wall 23 is placed on the outer side in the radial direction with respect to the impeller 6. An end portion on the lower side in the axial direction of the circumferential wall 23 is connected to the radially outer end of the bottom wall 22. An end portion on the upper side in the axial direction of the circumferential wall 23 is connected to the radially outer end of the top wall 21.

Figure 4:
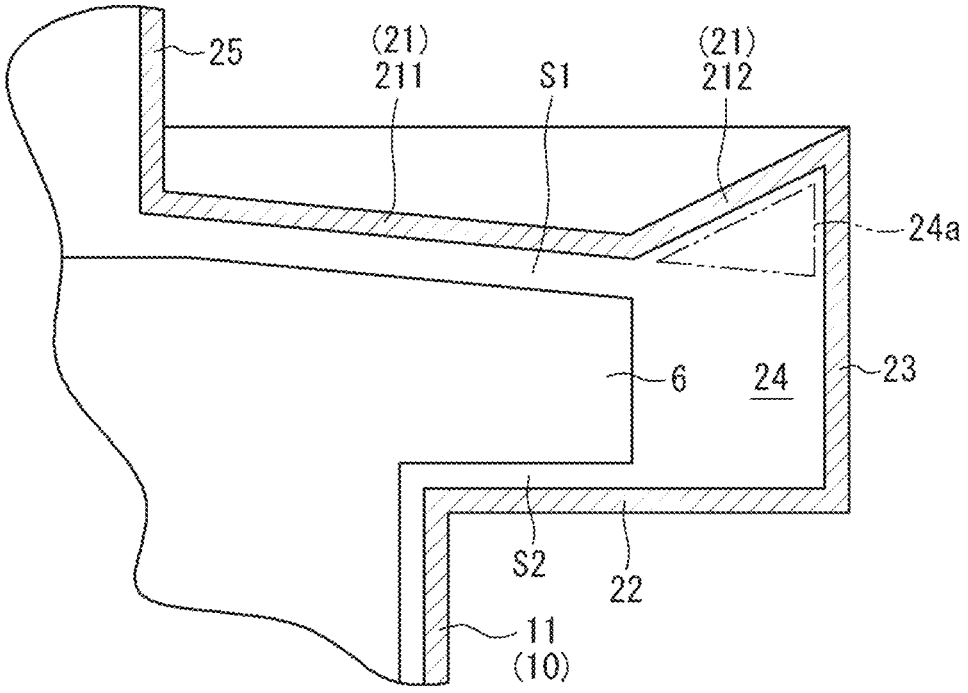
FIG. 4 is an enlarged cross-sectional view showing a main part of a volute portion.

FIG. 4 is an enlarged cross-sectional view showing a main part of the volute portion 20. In FIG. 1 and FIG. 4, the top wall 21 is placed on the upper side in the axial direction with respect to the impeller 6. The top wall 21 has an annular radially inner wall portion 211 that is placed on the inner side in the radial direction, and an annular radially outer wall portion 212 that is placed on the outer side in the radial direction. The radially inner wall portion 211 is placed with a first gap (gap) S1 on the upper side in the axial direction with respect to the impeller 6. The radially inner wall portion 211 is inclined parallel to the side plate 63 of the impeller 6. That is, the radially inner wall portion 211 extends diagonally toward the lower side in the axial direction and the outer side in the radial direction, from the radially inner end to the radially outer end thereof.

The radially outer wall portion 212 is placed on the outer side in the radial direction with respect to the impeller 6. The radially inner end of the radially outer wall portion 212 is connected to the radially outer end of the radially inner wall portion 211. The radially outer end of the radially outer wall portion 212 is connected to an end portion on the upper side in the axial direction of the circumferential wall 23. The radially outer wall portion 212 extends diagonally toward the upper side in the axial direction and the outer side in the radial direction, from the radially outer end of the radially inner wall portion 211 to the circumferential wall 23.

The bottom wall 22 is placed on the lower side in the axial direction with respect to the impeller 6. The bottom wall 22 of the present embodiment is placed with a second gap S2 on the lower side in the axial direction with respect to the impeller 6. The bottom wall 22 extends, parallel to the outer surface 61*a* of the main plate 61, straight toward the outer side in the radial direction. The inner circumferential edge of the bottom wall 22 is connected to the opening edge on the upper side in the axial direction of the cylindrical wall 11 of the housing portion 10. Accordingly, the internal space of the volute portion 20 communicates with the internal space of the housing portion 10.

The volute portion 20 further has a cylindrical suction portion 25 and a cylindrical discharge portion 26. The suction portion 25 is provided so as to project axially upward from the inner circumferential edge of the radially inner wall portion 211 of the top wall 21. The suction portion 25 has a suction port 25*a* through which the transport fluid is sucked into the volute portion 20. Therefore, the suction port 25*a* for the transport fluid is formed on the upper side in the axial direction of the volute portion 20. The discharge portion 26 is provided at a predetermined position on the outer circumference of the circumferential wall 23. The discharge portion 26 has a discharge port 26*a* through which the transport fluid is discharged to the outside of the volute portion 20.

A substantially annular volute flow path 24 in which the transport fluid that has flowed out from the outlet 66 of the impeller 6 flows is formed inside the volute portion 20. The volute flow path 24 is formed between the impeller 6 and the circumferential wall 23 and between the radially outer wall portion 212 of the top wall 21 and the bottom wall 22. The volute flow path 24 communicates with the first gap S1 and the second gap S2. The volute flow path 24 has a substantially annular expansion region 24*a* formed on the upper side in the axial direction. The expansion region 24*a* is formed such that the flow path cross-sectional area of the volute flow path 24 is expanded diagonally from the radially outer end of the first gap S1 toward the upper side in the axial direction and the outer side in the radial direction.

[Flow of Transport Fluid]

In FIG. 1 to FIG. 4, when the rotary shaft 3 is rotationally driven by the motor 4, the impeller 6 rotates around the axis C together with the rotary shaft 3, and the transport fluid is sucked into the volute portion 20 through the suction port 25*a* of the suction portion 25. The transport fluid sucked into the volute portion 20 flows into the impeller 6 through the inlet 64 of the impeller 6, and radially flows from the inner side in the radial direction toward the outer side in the radial direction of the impeller 6 due to a centrifugal force generated by the rotation of the impeller 6. Accordingly, the transport fluid passes through each flow path 65 between the adjacent vanes 62 and flows out to the volute flow path 24 through each outlet 66 at the outer circumference of the impeller 6. Most of the transport fluid that has flowed out to the volute flow path 24 flows in the circumferential direction within the volute flow path 24, flows into the discharge portion 26, and is discharged to the outside of the volute portion 20 through the discharge port 26*a*. The remaining part of the transferred fluid that has flowed out to the volute flow path 24 flows into the first gap S1 and the second gap S2.

The speed of the transport fluid flowing in the circumferential direction within the volute flow path 24 gradually decreases as the transport fluid is farther from the rotating impeller 6 toward the upper side in the axial direction and the outer side in the radial direction. In contrast, the flow path cross-sectional area of the expansion region 24*a* of the volute flow path 24 is expanded toward the upper side in the axial direction and the outer side in the radial direction. Therefore, the speed of the transport fluid flowing through the expansion region 24*a* is made lower than the speed of the transport fluid flowing through the other region of the volute flow path 24.

When the speed of the transport fluid in the expansion region 24*a* decreases, the pressure of the transport fluid in the expansion region 24*a* increases. Accordingly, the pressure of the transport fluid in the first gap S1 is increased by propagation of the increased pressure in the expansion region 24*a* to the first gap S1. Due to this pressure increase, a thrust force pushing the impeller 6 toward the lower side in the axial direction is increased.

[Effect Confirmation Test]

A test for confirming the effects of the pump 1 of the present embodiment was conducted. In this test, for a conventional pump and the pump 1 of the present embodiment, the pressure of the transport fluid in the first gap S1, the thrust force in the axial direction, and a lifting height during operation were calculated using fluid analysis software.

Figure 5:
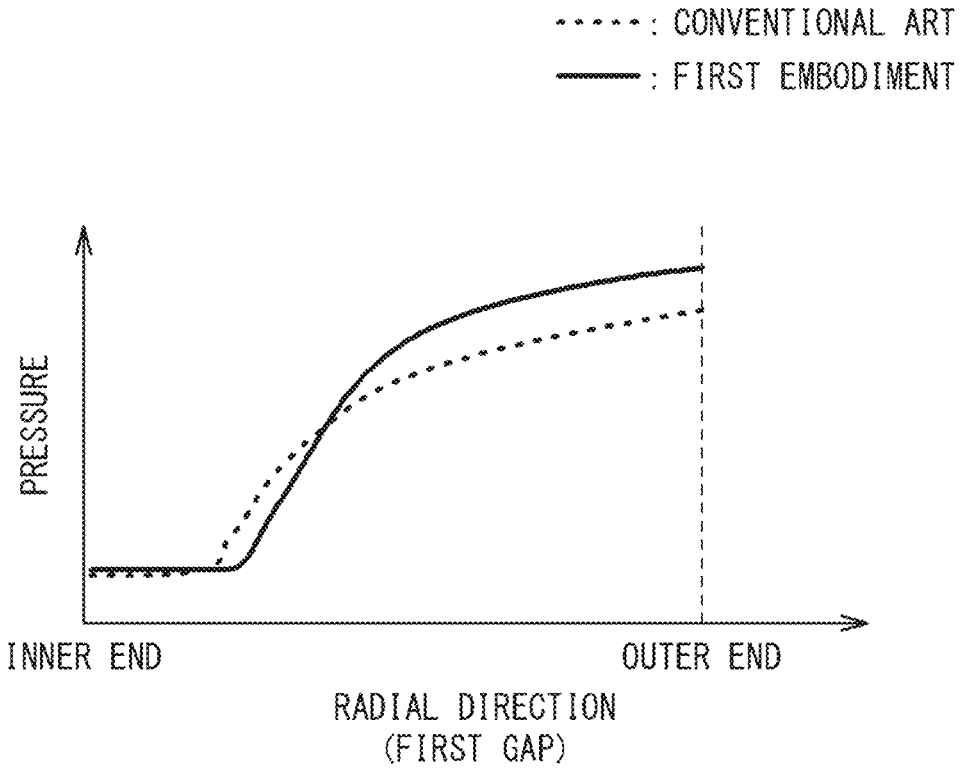
FIG. 5 is a graph showing test results for the pressure of a transport fluid in a first gap.

FIG. 5 is a graph showing test results for the pressure of the transport fluid in the first gap S1. As shown in FIG. 5, it was confirmed that, in the pump 1 of the present embodiment, the pressure of the transport fluid increased in a range from a middle portion in the radial direction to the outer end in the first gap S1, as compared to that in the conventional pump. It can be found that, due to the increase in the pressure of the transport fluid in the first gap S1, the thrust force pushing the impeller 6 toward the lower side in the axial direction is increased.

Figure 6:
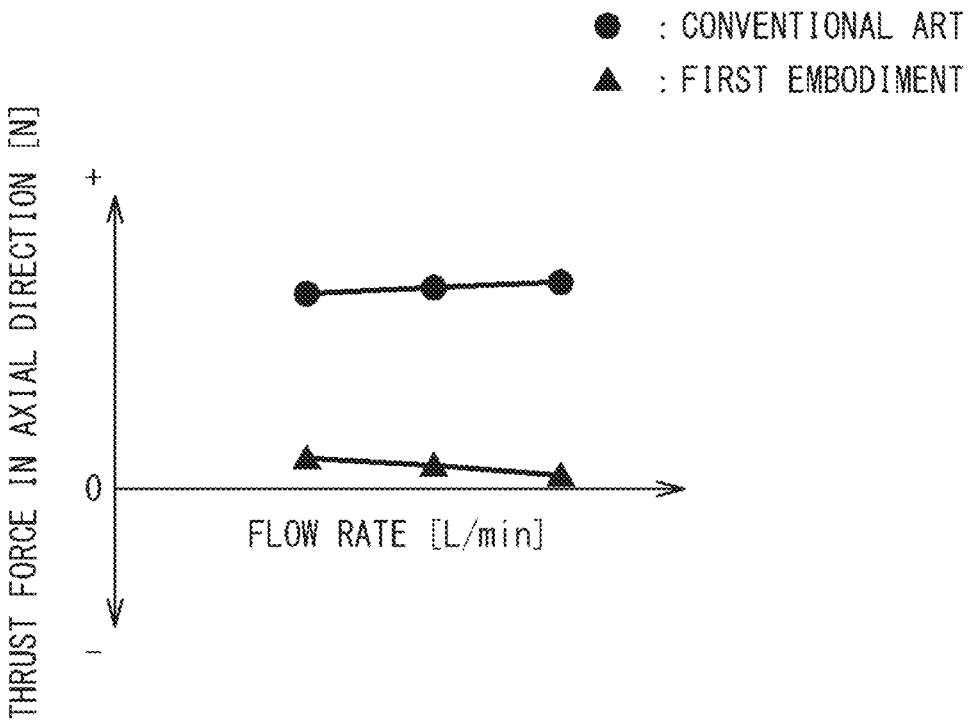
FIG. 6 is a graph showing test results for a thrust force in the axial direction acting on the impeller.

FIG. 6 is a graph showing test results for the thrust force in the axial direction acting on the impeller 6. Here, the thrust force in the axial direction acting on the impeller 6 is the difference between a thrust force pushing the impeller 6 toward the upper side in the axial direction (positive side) and a thrust force pushing the impeller 6 toward the lower side in the axial direction (negative side). Therefore, this means that the smaller the thrust force in the axial direction is, the more the movement of the impeller 6 in the axial direction is suppressed. As shown in FIG. 6, it was confirmed that, in the pump 1 of the present embodiment, compared to the conventional pump, the thrust force in the axial direction is greatly decreased on the positive side, so that the movement of the impeller 6 toward the upper side in the axial direction is suppressed.

Figure 7:
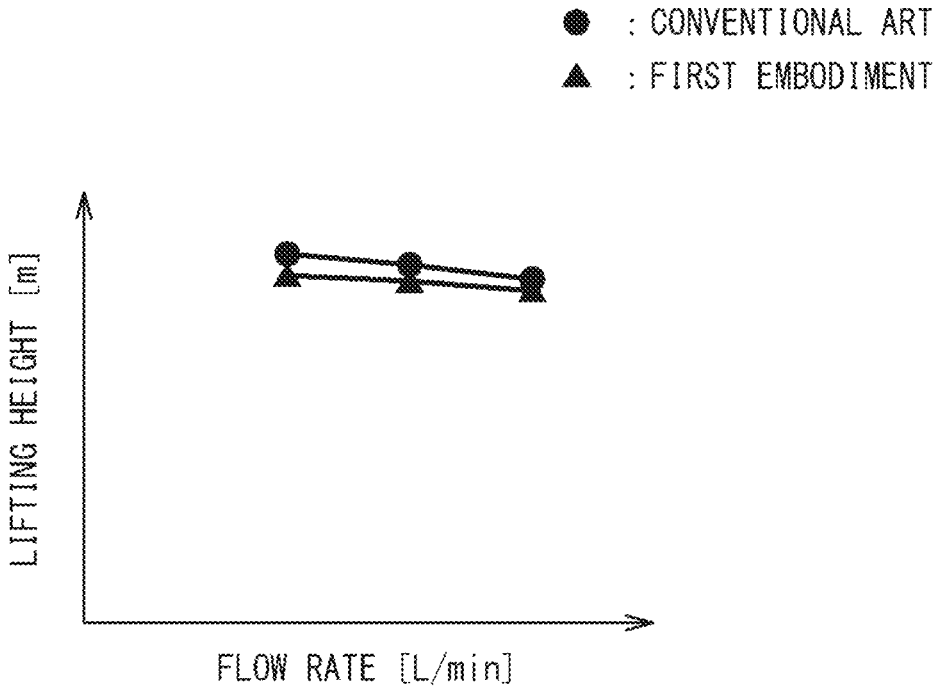
FIG. 7 is a graph showing test results for the lifting height of the pump.

FIG. 7 is a graph showing test results for the lifting height of the pump 1. Generally, when the thrust force in the axial direction acting on the impeller 6 is greatly reduced, the lifting height of the pump 1 is also greatly reduced accordingly. However, as shown in FIG. 6 and FIG. 7, it was confirmed that, in the pump 1 of the present embodiment, compared to the conventional pump, even when the thrust force in the axial direction is greatly decreased, the degree of decrease in the lifting height is reduced.

[Advantageous Effects]

In the magnetic levitation type pump 1 of the first embodiment, the top wall 21 of the volute portion 20 has the radially inner wall portion 211 that is placed with the first gap S1 on the upper side in the axial direction (suction port 25*a* side) with respect to the impeller 6, and the radially outer wall portion 212 that extends diagonally from the radially outer end thereof toward the upper side in the axial direction and the outer side in the radial direction. Accordingly, in the volute flow path 24 within the volute portion 20, the expansion region 24*a* is formed such that the flow path cross-sectional area thereof is expanded diagonally from the radially outer end of the first gap S1 toward the upper side in the axial direction and the outer side in the radial direction. The expansion region 24*a* is formed so as to extend away from the impeller 6 toward the upper side in the axial direction and the outer side in the radial direction, so that the speed of the transport fluid flowing through the expansion region 24*a* decreases and the pressure of the transport fluid in the expansion region 24*a* increases. As a result, the increased pressure in the expansion region 24*a* propagates to the first gap S1 and the pressure of the transport fluid in the first gap S1 increases, so that the thrust force pushing the impeller 6 toward the lower side in the axial direction increases. Accordingly, the movement of the impeller 6 toward the upper side in the axial direction due to the pressure of the transport fluid being decreased in the vicinity of the suction port 25*a* of the volute portion 20 as in the conventional art can be suppressed.

In addition, the transport fluid in the expansion region 24*a* flows smoothly along the diagonally extending radially outer wall portion 212 of the top wall 21, so that the transport fluid can be inhibited from staying in the expansion region 24*a*. As a result, a decrease in the performance of transporting the transport fluid by the pump 1 can be suppressed.

Second Embodiment

Figure 8:
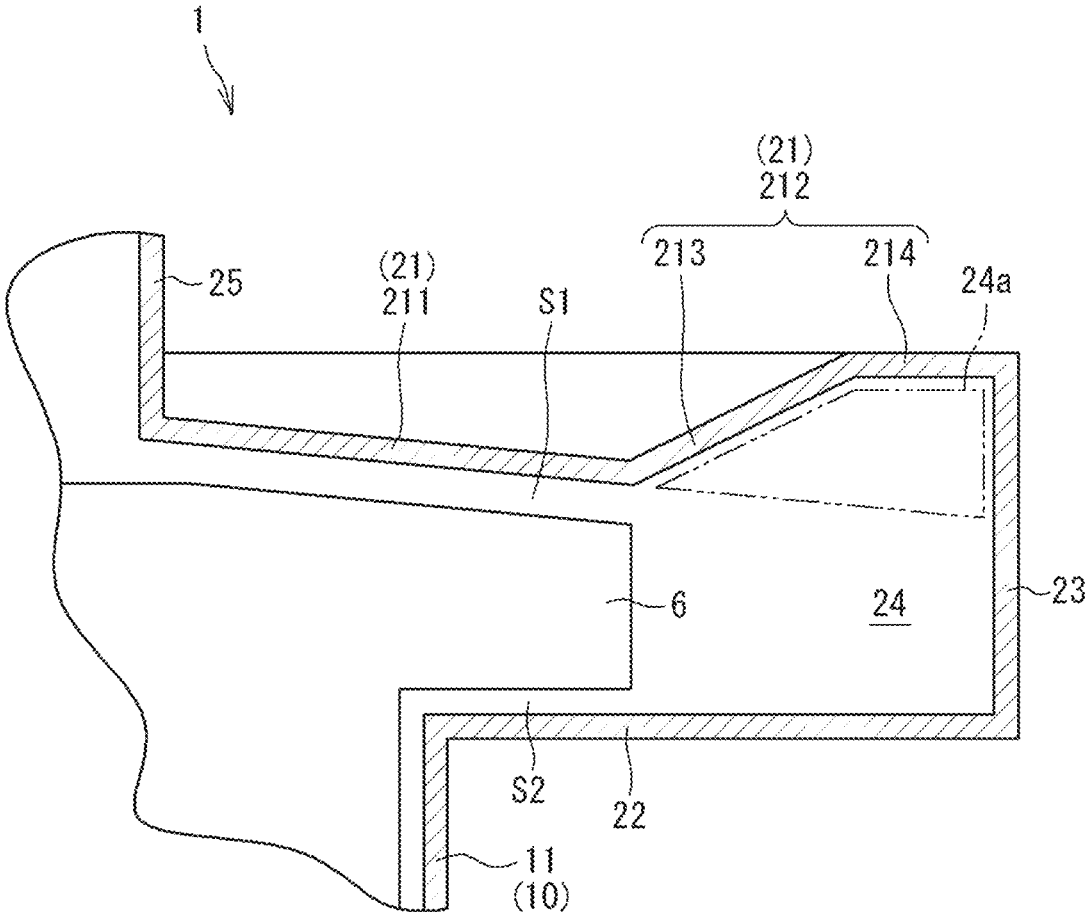
FIG. 8 is an enlarged cross-sectional view showing a main part of a volute portion of a pump according to a second embodiment of the present disclosure.

FIG. 8 is an enlarged cross-sectional view showing a main part of a volute portion 20 of a magnetic levitation type pump 1 according to a second embodiment of the present disclosure. In the present embodiment, the shape of a radially outer wall portion 212 of a top wall 21 of the volute portion 20 is different from that of the first embodiment. The radially outer wall portion 212 of the top wall 21 in the present embodiment has a first wall portion 213 that is located on the inner side in the radial direction of a volute flow path 24, and a second wall portion 214 that is located on the outer side in the radial direction of the volute flow path 24.

The radially inner end of the first wall portion 213 is connected to the radially outer end of a radially inner wall portion 211. The first wall portion 213 extends diagonally from the radially outer end of the radially inner wall portion 211 toward the upper side in the axial direction and the outer side in the radial direction. The radially inner end of the second wall portion 214 is connected to the radially outer end of the first wall portion 213. The second wall portion 214 extends, parallel to the bottom wall 22, straight from the radially outer end of the first wall portion 213 toward the outer side in the radial direction. The radially outer end of the second wall portion 214 is connected to an end portion on the upper side in the axial direction of a circumferential wall 23. The other components of the present embodiment are the same as those of the first embodiment, and thus are designated by the same reference signs, and the description thereof is omitted.

According to the present embodiment, the flow path cross-sectional area of the expansion region 24*a* of the volute flow path 24 is formed to be larger on the outer side in the radial direction than in the first embodiment (see FIG. 4). Therefore, the speed of the transport fluid flowing through the expansion region 24*a* further decreases, so that the pressure of the transport fluid in the expansion region 24*a* further increases. As a result, the pressure of the transport fluid in the first gap S1 further increases, so that the thrust force pushing the impeller 6 toward the lower side in the axial direction further increases. Accordingly, the movement of the impeller 6 toward the upper side in the axial direction due to the pressure of the transport fluid being decreased in the vicinity of the suction port 25*a* of the volute portion 20 as in the conventional art can be effectively suppressed.

In addition, the transport fluid in the expansion region 24*a* flows smoothly along the slope of the first wall portion 213, which is a part of the radially outer wall portion 212, so that the transport fluid can be inhibited from staying in the expansion region 24*a*. As a result, a decrease in the performance of transporting the transport fluid by the pump 1 can be suppressed.

Others

In the second embodiment, the first wall portion 213 of the top wall 21 extends diagonally from the radially outer end of the radially inner wall portion 211 toward the upper side in the axial direction and the outer side in the radial direction, but may extend straight from the radially outer end of the radially inner wall portion 211 toward the upper side in the axial direction. In addition, in the second embodiment, the second wall portion 214 of the top wall 21 extends straight from the radially outer end of the first wall portion 213 toward the outer side in the radial direction, but may extend diagonally from the radially outer end of the first wall portion 213 toward the lower side in the axial direction and the outer side in the radial direction.

The embodiments disclosed herein are merely illustrative and not restrictive in all aspects. The scope of the present invention is defined by the scope of the claims rather than the meaning described above, and is intended to include meaning equivalent to the scope of the claims and all modifications within the scope.

REFERENCE SIGNS LIST

1 magnetic levitation type pump
2 casing
3 rotary shaft
4 motor
5 magnetic bearing portion
6 impeller
20 volute portion
21 top wall
22 bottom wall
23 circumferential wall
24 volute flow path
25*a* suction port
66 outlet
211 radially inner wall portion
212 radially outer wall portion
C axis
S1 first gap (gap)

The invention claimed is:

1. A magnetic levitation type pump comprising:
a rotary shaft rotatable around an axis;
a motor configured to rotationally drive the rotary shaft;
a magnetic bearing portion supporting the rotary shaft in a non-contact manner;
a casing having a volute portion in which a suction port for a transport fluid is formed on one side in an axial direction; and
an impeller placed inside the volute portion so as to be rotatable together with the rotary shaft and having an outlet for the transport fluid at an outer circumference thereof, wherein
the volute portion has
an annular top wall that is placed on the one side in the axial direction with respect to the impeller,
a bottom wall that is placed on another side in the axial direction with respect to the impeller, and
a cylindrical circumferential wall that is placed on an outer side in a radial direction with respect to the impeller and has end portions in the axial direction connected to the top wall and the bottom wall, respectively,
the top wall has a radially inner wall portion that is placed with a gap on the one side in the axial direction with respect to the impeller, and a radially outer wall portion that is placed on the outer side in the radial direction with respect to the impeller,
a volute flow path in which the transport fluid that has flowed out from the outlet is formed between the impeller and the circumferential wall and between the radially outer wall portion and the bottom wall in the volute portion so as to communicate with the gap, and
at least a part of the radially outer wall portion extends diagonally from a radially outer end of the radially inner wall portion toward the one side in the axial direction and the outer side in the radial direction.

2. The magnetic levitation type pump according to claim 1, wherein the radially outer wall portion extends diagonally toward the one side in the axial direction and the outer side in the radial direction, from the radially outer end of the radially inner wall portion to the circumferential wall.

* * * * *